US005590998A

United States Patent [19]

Wilcox

[11] Patent Number: 5,590,998

[45] Date of Patent: Jan. 7, 1997

[54] LIFTING DEVICE

[76] Inventor: Andrew J. Wilcox, RMB 6475, Shady Creek, Victoria 3821, Australia

[21] Appl. No.: 494,448

[22] Filed: Jun. 26, 1995

[30] Foreign Application Priority Data

Jun. 27, 1994 [AU] Australia ..... PM6485

[51] Int. Cl.[6] ..... B66F 9/06

[52] U.S. Cl. ..... 414/607; 414/629; 414/639; 414/642

[58] Field of Search ..... 414/462, 540, 414/607, 628–629, 639–642, 920

[56] References Cited

U.S. PATENT DOCUMENTS

| | | | |
|---|---|---|---|
| 2,653,678 | 9/1953 | Lehrman | 414/639 X |
| 3,045,847 | 7/1962 | Fisher | 414/607 X |
| 3,175,721 | 3/1965 | Smith | 414/785 X |
| 3,266,599 | 8/1966 | Dearden | 414/639 X |
| 3,497,095 | 2/1970 | Couberly | 414/629 |
| 4,177,001 | 12/1979 | Blackwood | 414/628 |
| 4,325,666 | 4/1982 | Chain et al. | 414/540 X |
| 4,365,921 | 12/1982 | Brouwer et al. | 414/629 X |
| 4,640,662 | 2/1987 | Spellman, Jr. | 414/642 |

FOREIGN PATENT DOCUMENTS

| | | | |
|---|---|---|---|
| 0250018 | 12/1987 | European Pat. Off. | 414/629 |

*Primary Examiner*—James W. Keenan
*Attorney, Agent, or Firm*—Bell, Seltzer, Park & Gibson, P.A.

[57] ABSTRACT

A lifting device for attachment to a vehicle such as a four wheel motorcycle, the lifting device including upper and lower mounting members and for mounting the device to the framework of the vehicle, a mast which is pivotally connected to the mounting members for tilting movement about a generally horizontal axis by members of a tilting ram which acts between the mounting members and the mast, the lifting device further including a pair of forks and a forklift ram which is operable to raise and lower the forks.

10 Claims, 5 Drawing Sheets

LIFTING DEVICE

FIELD OF THE INVENTION

This invention relates to a lifting device.

BACKGROUND OF THE INVENTION

More particularly, the invention relates to a lifting device which can be fitted to a vehicle such as a four wheel motorcycle or the like.

Four wheel motorcycles are frequently used by farmers, horticulturalists, nurserymen and the like for transportation purposes. These machines are capable of travelling over relatively rough terrain and working in confined spaces. The machines have some capability of transporting loads. They are not really designed for convenient lifting and transportation of loads.

An object of the present invention is to provide a lifting device which can be mounted to a light vehicle such as a four wheel motorcycle.

According to the present invention there is provided a lifting device for attachment to a vehicle, said lifting device comprising mounting means for mounting the device to the framework of the vehicle, a mast pivotally connected to the mounting means for tilting movement about a generally horizontal axis, a tilt ram acting between the mounting means and the mast for controlling tilting movements of the mast, said mast including a pair of forks and a fork lift ram operable in use to raise and lower the forks relative to the mast.

The lifting device of the invention can be made as a light compact form of lifting device which, when mounted on a vehicle, enables the vehicle to function analogous to a forklift truck.

The invention also provides a vehicle having a lifting device as defined above fitted thereto.

Preferably, the vehicle comprises a four wheel motorcycle.

Preferably further, the lifting device is mounted at the front of the vehicle and a counterweight is detachably mounted at the rear of the vehicle.

In alternative arrangements, the lifting device can be mounted on the vehicle at the time of manufacture.

BRIEF DESCRIPTION OF THE DRAWINGS

The invention will now be further described with reference to the accompanying drawings, in which.

DETAILED DESCRIPTION OF THE DRAWINGS

Figure 1:
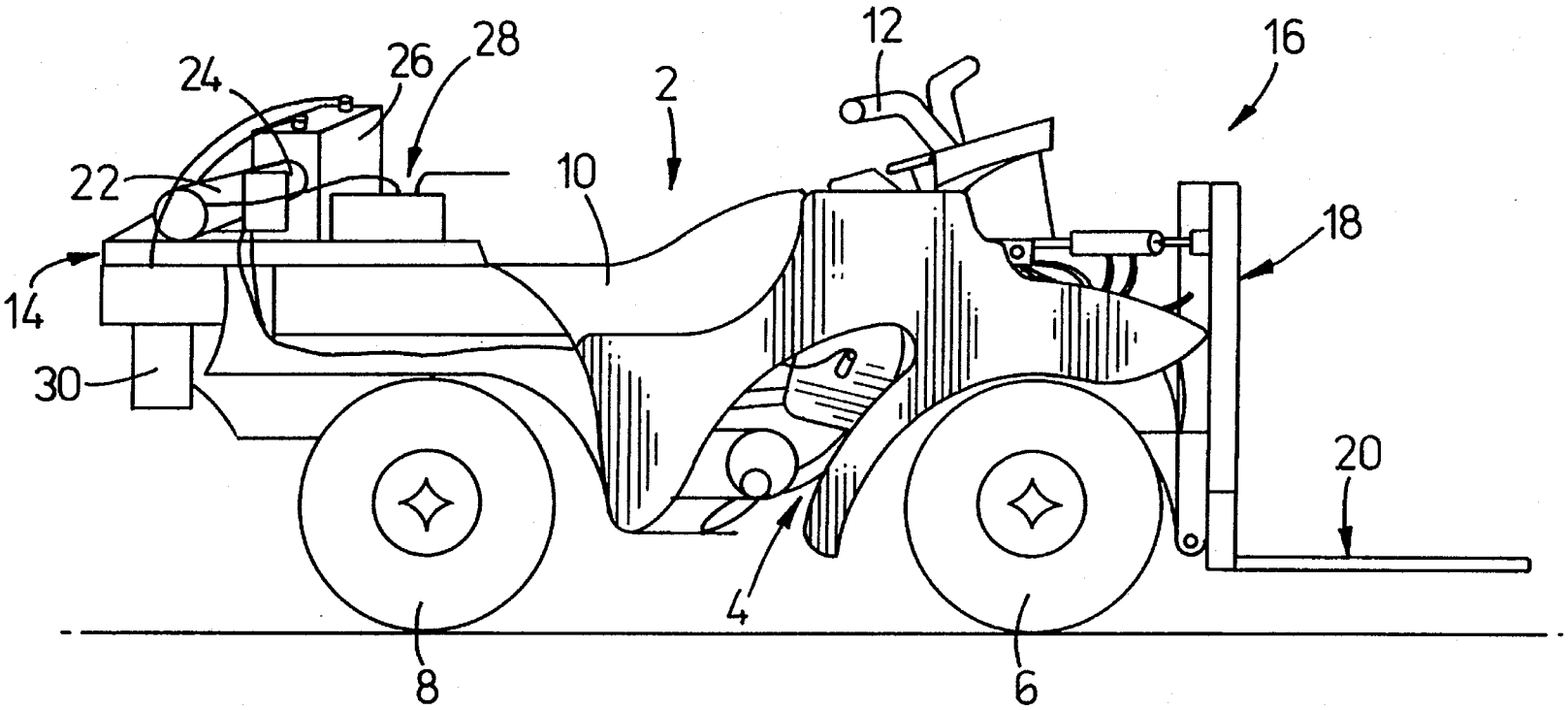
FIG. 1 is a side view of a four wheel motorcycle having a lifting device mounted thereto.
Figure 2:
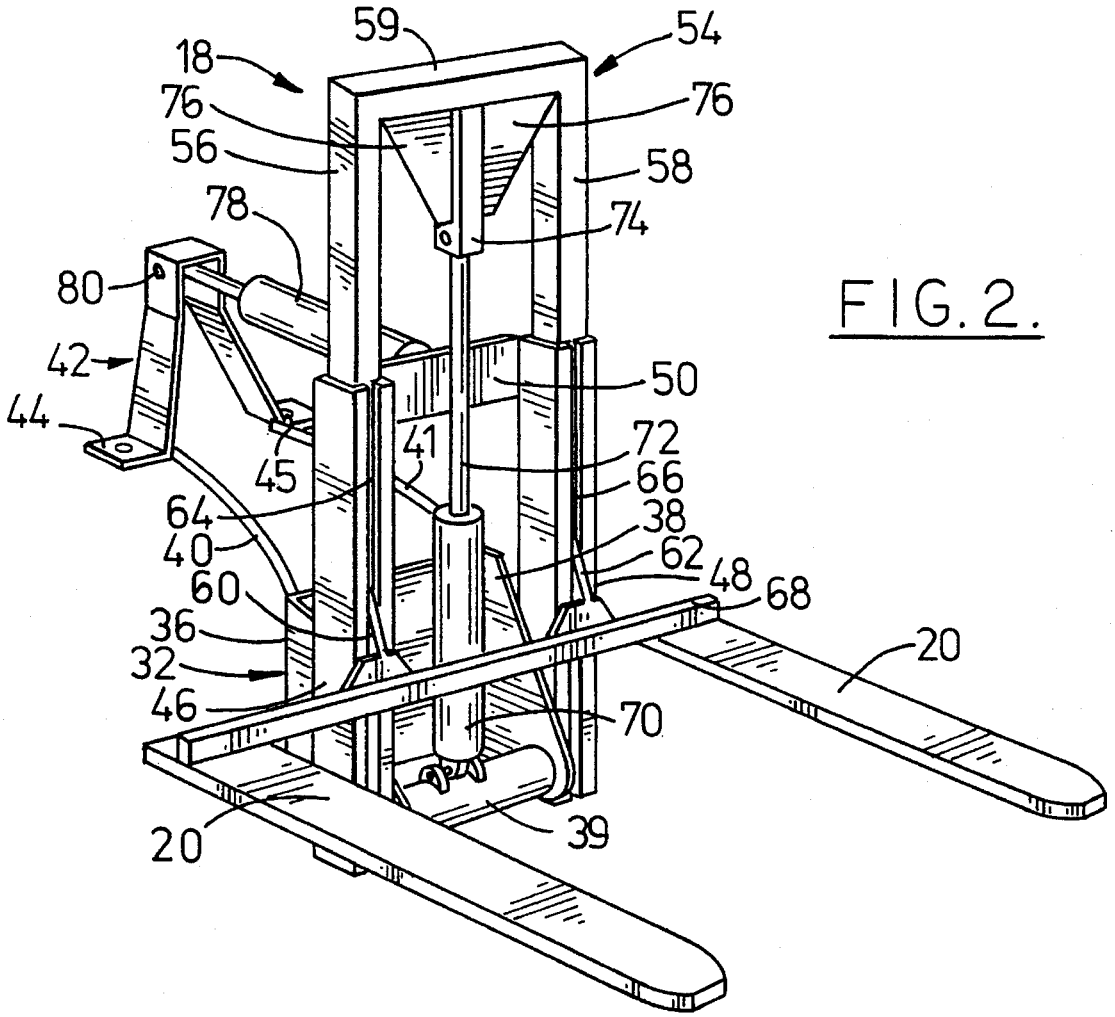
FIG. 2 is a simplified perspective view of a lifting device of the invention.

FIG. 1 illustrates a four wheel motorcycle 2 having a framework 4, front wheels 6 and rear wheels 8. The motorcycle includes a saddle 10 and handlebars 12 which are fitted with the usual controls. The motorcycle includes a rear storage rack 14. FIG. 1 shows a lifting device 16 of the invention fitted to the front of the motorcycle 2. The device includes a tiltable mast 18 and forks 20. Hydraulic rams are provided to control tilting of the mast and raising and lowering of the forks 20. An hydraulic pump 22 is mounted on the rack 14, the pump being driven by an electric motor 24 which is powered by means of a battery 26. Fluid from the pump 22 is applied to the rams via control valves 28 having two levers which are used to control up and down movement of the forks 20 and forward and rearward tilting movement of the mast 18.

A counterweight 30 is suspended from the rack 14 so as to assist in maintaining balance of the motorcycle 2 when the forks 20 are used to lift and move a load. It is preferred that the counterweight 30 comprises a weight of about 100 kg which is detachably connected to the framework 4.

FIGS. 2 to 5 illustrate in more detail the lifting device 16 of the invention. The device includes a main mounting bracket 32 which in use is bolted to a forward part of the framework 4 of the motorcycle. The part of the framework selected will depend on the construction of the vehicle but usually vehicles of this sort have suitable structural beams for supporting the front axles and steering assembly. The main mounting bracket 32 includes a rear plate 34 and two side webs 36 and 38. A tubular shaft 39 is welded between the side webs 36 and 38. A pair of bars 40 and 41 extend upwardly from the bracket 32 and are welded to an upper mounting bracket 42. The mounting bracket 42 has laterally projecting flanges 44 and 45 which can be used for further bolted connections to the framework 4 of the vehicle.

Figure 4:
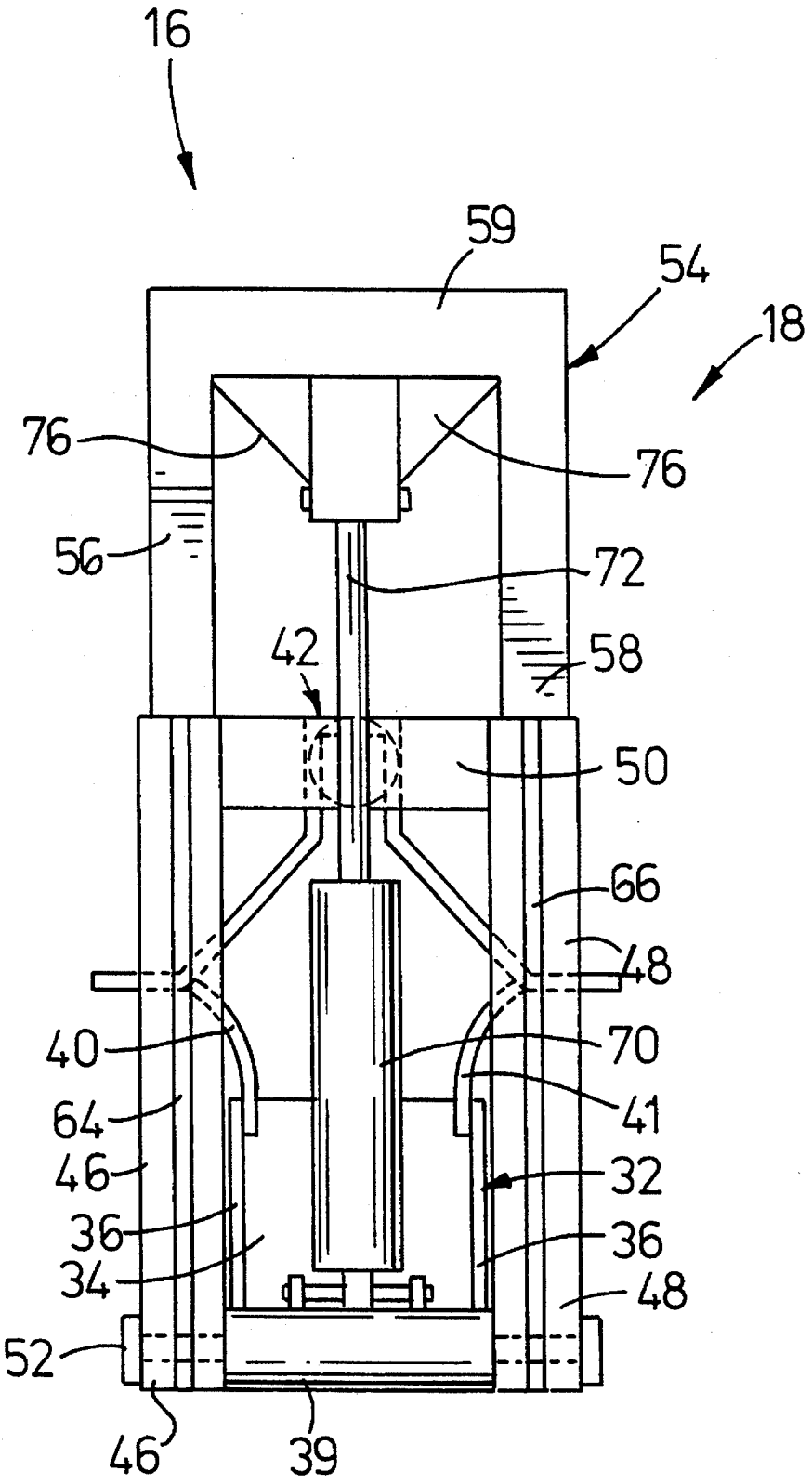
FIG. 4 is a frontal view (with the forks removed)

The mast 18 is pivotally connected to the main mounting bracket 32. The mast includes a pair of slotted hollow uprights 46 and 48 which are connected at the upper ends by means of a cross plate 50. The lower ends of the uprights 46 and 48 are interconnected by means of a large pin 52 which passes through the tubular shaft 39 and forms a pivotal connection therewith (as best seen in FIG. 4). The mast includes a fork carriage assembly 54 having a pair of uprights 56 and 58 which are slidably received in the uprights 46 and 48 respectively. The upper ends of the uprights 56 and 58 are interconnected by a top beam 59. The fork carriage includes mounting plates 60 and 62 which are connected to the lower ends of the uprights 56 and 58 and which project through the slots 64 and 66 in the uprights 46 and 48. The carriage includes a transverse beam 68 which is connected to the plates 60 and 62, the forks 20 being connected to the beam 68. The size and spacing of the forks 20 can be adapted to suit pallets of standard sizes.

The fork carriage is raised and lowered by means of an hydraulic ram 70, the lower end of which is pivotally connected to the tubular shaft 39. The other end of the shaft 72 of the ram is pivotally connected to a mounting leg 74 which extends downwardly from the beam 59. The leg 74 is supported by means of gusset plates 76.

Figure 3:
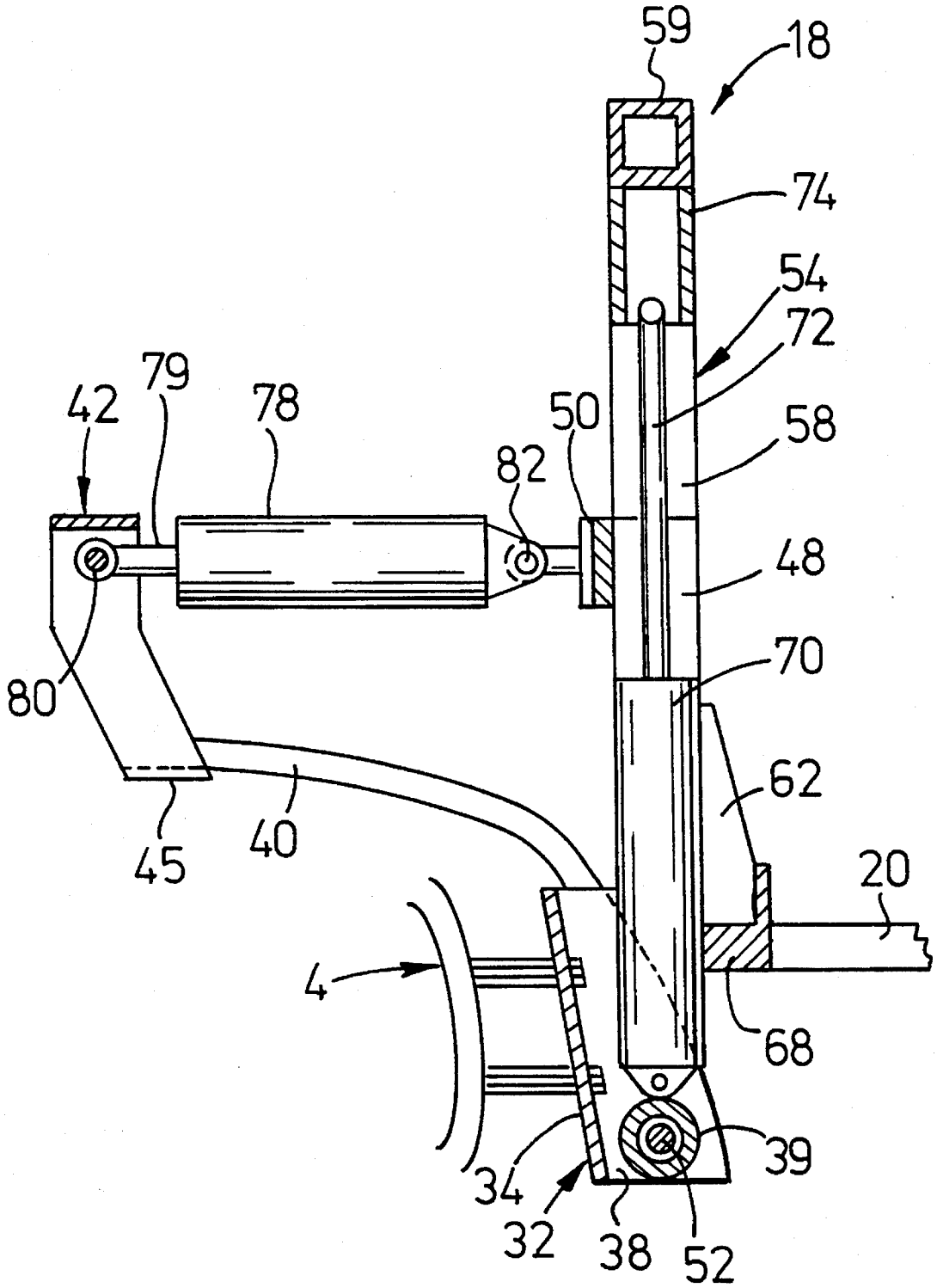
FIG. 3 is a schematic side view of the device partly in section.
Figure 5:
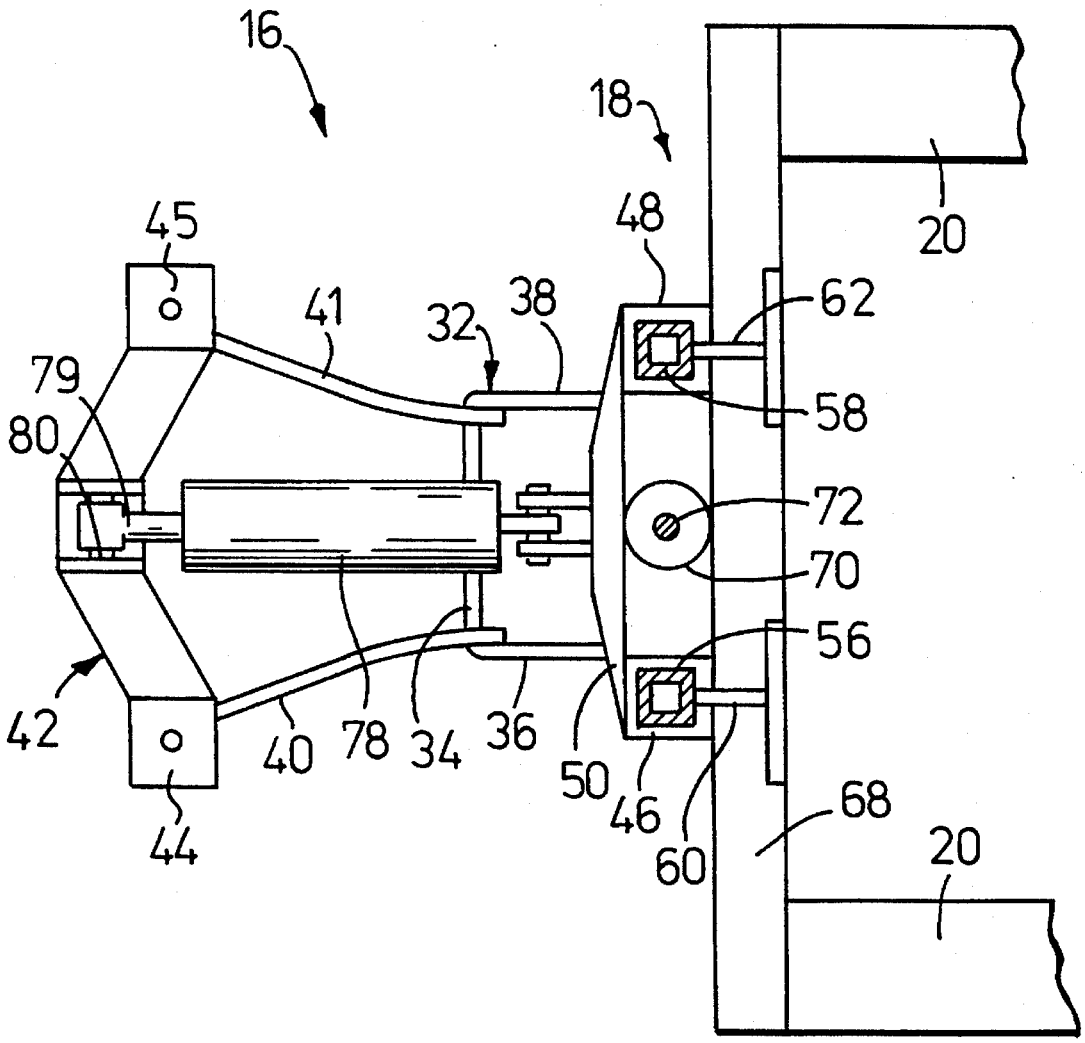
FIG. 5 is a schematic plan view of the device.

The mast 18 pivots about the pin 52 which passes through the tubular shaft 39. Tilting movements are effected by means of a tilting ram 78, the shaft 79 of which is pivotally connected to the upper mounting bracket 42 by means of a pin 80. The other end of the ram 78 is pivotally connected to the cross plate 50 by means of a pivot pin 82, as best seen in FIGS. 3 and 5. When the tilting ram 78 is operated, the mast 18 rotates about a horizontal axis which is concentric with the pin 52. This enables the forks 20 to be dipped in order to facilitate entry of them into the openings of a pallet (not shown). When the pallet is securely located on the forks, the tilting ram 78 can be retracted to tilt the mast 18 rearwardly so that the pallet is in a more stable position on the forks for transport. The ram 70 is used for raising and lowering the fork carriage 54 which causes raising and lowering of the forks 20 and the pallet thereon.

It will be appreciated by those skilled in the art that the device 16 of the invention is relatively simple, robust and inexpensive. It can readily be made to lift loads of about 160 kg.

Whilst it is envisaged that the device 16 would normally be supplied as a detachable accessory for a four wheel motorcycle, it could be permanently incorporated into a motorcycle at the time of manufacture.

I claim:

1. A lifting device in combination with a motor vehicle having a frame comprising upper and lower portions thereof, said lifting device being removably mounted to the vehicle frame and comprising removable mounting members therefor, said removable mounting members comprising an upper mounting bracket detachably coupled to the upper portion of the vehicle frame and a lower mounting bracket detachably coupled to the lower portion of the vehicle frame, said lifting device further comprising a mast pivotally connected to the lower mounting bracket for tilting said mast about a generally horizonal axis and a pair of forks and a fork lift ram for raising and lowering the forks relative to the mast, wherein said mast is coupled to the upper mounting bracket by a tilting ram positioned between and connecting the upper mounting bracket and the mast to provide said tilting movement of the mast about said axis, said lower mounting bracket includes a rear plate connected to side webs and a tubular shaft extending between the side webs, wherein a lower end of the lift ram is pivotally connected to said tubular shaft and said mast includes a pair of slotted hollow uprights and a pair of upright beams which are slidably mounted in respective ones of the hollow uprights with the forks being connected to said upright beams, said lower ends of the uprights being pivotally connected to the lower mounting bracket by a pin which passes through said tubular shaft, and wherein the upper ends of the upright beams are connected together by a top beam with an upper end of the lift ram being coupled to said top beam.

2. A lifting device as claimed in claim 1 comprising support bars connected between the upper and lower mounting brackets.

3. A lifting device as claimed in claim 1 wherein a cross member interconnects the upper ends of the hollow uprights and wherein the tilt ram is connected between the upper mounting bracket and said cross member.

4. A lifting device as claimed in claim 1 wherein said tilt and lift rams comprise hydraulic rams, said lifting device further comprising an hydraulic pump and control valve means to control flow of hydraulic fluid to said hydraulic rams.

5. A lifting device as claimed in claim 4 wherein said hydraulic pump and a battery therefor are mounted at the rear of the motorcycle vehicle with said lifting device being mounted at the front thereof.

6. A lifting device as claimed in claim 5, further including a counter-weight provided at the rear of the motorcycle vehicle to at least partially counteract the effect of a load on a lifting device.

7. A lifting device for attachment to a motor vehicle having a frame comprising upper and lower portions thereof, said lifting device comprising removable mounting members and being configured to removably mount to the vehicle frame, said removable mounting members comprising an upper mounting bracket configured to detachably couple to the upper portion of the vehicle frame and a lower mounting bracket configured to detachably couple to the lower portion of the vehicle frame, said lifting device further comprising a mast pivotally connected to the lower mounting bracket for tilting said mast about a generally horizontal axis, said lifting device further comprising a pair of forks and a fork lift ram for raising and lowering the forks relative to the mast, wherein the mast is coupled to the upper mounting bracket with a tilting ram positioned between and connecting the upper mounting bracket and the mast to provide said tilting movement of the mast about said axis, wherein the lower mounting bracket includes a rear plate connected to side webs and a tubular shaft extending between the side webs, a lower end of the lift ram being pivotally connected to said tubular shaft, wherein the mast includes a pair of slotted hollow uprights and a pair of upright beams which are slidably mounted in respective ones of the hollow uprights with the forks being connected to said upright beams, wherein lower ends of the uprights are pivotally connected to the lower mounting bracket by means of a pin which extends through said tubular shaft, and wherein the upper ends of the upright beams are connected together by a top beam with an upper end of the lift ram being coupled to said top beam.

8. A lifting device as claimed in claim 7 comprising support bars connected between the upper and lower mounting brackets.

9. A lifting device as claimed in claim 7 wherein a cross member interconnects the upper ends of the hollow uprights and wherein the tilt ram is connected between the upper mounting bracket and said cross member.

10. A lifting device as claimed in claim 7 wherein said tilt and lift rams comprise hydraulic rams, said lifting device further comprising an hydraulic pump and control valve means to control flow of hydraulic fluid to said hydraulic rams.

* * * * *